United States Patent [19]

Kurze et al.

[11] Patent Number: 4,869,789

[45] Date of Patent: Sep. 26, 1989

[54] METHOD FOR THE PREPARATION OF DECORATIVE COATING ON METALS

[75] Inventors: Peter Kurze, Oberlichtenau; Waldemar Krysmann; Maria Berger, both of Karl-Marx-Stadt; Klaus Rabending, Taura; Joachim Schreckenbach, Limbach-Oberfrohna; Thomas Schwarz, Karl-Marx-Stadt; Karl-Heinz Hartmann, Güntersberge, all of German Democratic Rep.

[73] Assignee: Technische Universitaet Karl-Marx-Stadt, Karl-Marx-Stadt, German Democratic Rep.

[21] Appl. No.: 151,363

[22] Filed: Feb. 2, 1988

[30] Foreign Application Priority Data

Feb. 2, 1987 [DD] German Democratic Rep. ... 299618
Feb. 2, 1987 [DD] German Democratic Rep. ... 229620

[51] Int. Cl.[4] ..... C25D 11/02; C25D 11/04

[52] U.S. Cl. ..... 204/56.1; 204/58

[58] Field of Search ..... 204/56.1, 58

[56] References Cited

U.S. PATENT DOCUMENTS 4,144,142 3/1979 Takahashi ..... 204/58

*Primary Examiner*—T. M. Tufariello
*Attorney, Agent, or Firm*—Jordan and Hamburg

[57] ABSTRACT

The process for producing decorative coatings on metals is primarily used in the jewelry industry, in handicrafts, and in device construction according to the invention, matte, true-to-form decorative coatings with a homogenous thickness of 3 μm to 30 μm are provided means of an electrochemical and plasmachemical reaction using a pulse operation in aqueous electrolytes at voltage peaks of 250 V to 750 V, pulse times of 20 μs to 2 ms, pulse frequencies of 35 Hz to 300 Hz, pulse currents from 20 A to 120 A, electrolyte temperatures between 318 K and 360 K, and average current densities from 0.1 A $cm^{-2}$ to 1 A $cm^{-2}$.

9 Claims, No Drawings

METHOD FOR THE PREPARATION OF DECORATIVE COATING ON METALS

BACKGROUND OF THE INVENTION

The invention concerns a method for preparing decorative coatings on metals, especially on aluminum, titanium, niobium, zirconium, tantalum, and their alloys, preferably for the jewelry industry, handicrafts, device construction, claddings and coins, metal-plastic art, and medals.

At the present time special multi-stage procedures are used to obtain nonshiny, matte surfaces on relatively cheap, easily machinable, and processable metals. These procedures roughen, structurize, coat, color, and seal the surface.

On conventional metals of the jewelry and custom jewelry industry, e.g. silver, gold, platinum, such matte surfaces cannot be achieved directly and can be achieved indirectly only through organic or inorganic coatings layers. But visually they reduce the value of the noble and expensive base material. Known methods for producing decorative and colored metal surfaces include the Kalcolor process or color anodizing (U.S. Pat. No. 3,631,384). Here the color is generated directly by the electrolyte, or organic dyes or inorganic color pigments are subsequently placed into the transparent carrier layer in order to provide color. This carrier layer is produced, for example in the case of aluminum, by anodizing with direct or alternating current in sulfuric-, phosphoric-, maleic-, salicyl-oxalic-acid electrolytes. But such surfaces always exhibit a "cold" sheen. Furthermore, these relatively expensive multi-stage processes can achieve a homogeneous surface decoration on e.g. plastic art, medals, hollow bodies, delicate structures, brooches, and the like either not at all or only with great technical effort. Furthermore, it is known that transparent coatings of aluminum oxide, produced by the anodic oxidation of aluminum, can subsequently be colored with various dyes (U.S. Pat. No. 3,031,387). Since these coatings are transparent, the metallic sheen of the surface always remains preserved. The organic compounds used to dye the coatings are furthermore affected by environmental factors such as radiation, temperature, and humidity, and change their hue.

Various decorative metal surfaces are also known in the jewelry industry. For example, in patent No. DD-WP 204845 the utilization of electronic parts as jewelry is described and in patent No. DE-OS 1446289 a special enameling process for decorative coatings on jewelry is presented. Colored, anodized aluminum parts are also used as jewelry elements.

SUMMARY OF THE INVENTION

The object of the invention is to provide a process by means of which visually attractive, decorative, matte, white, black, or colored coatings can be created on arbitrarily shaped surfaces on the metals aluminum, titanium, niobium, zirconium, tantalum and their alloys, where these coatings have all-round high dimensional stability, adhesion, and color homogeneity.

According to the invention, this object is achieved in the following manner: In an aqueous electrolyte, matte, decorative coatings that are true to form, with a homogeneous thickness of 3 μm to 30 μm, are formed on a barrier-layer forming metal selected from aluminum, titanium, tantalum, zirconium, niobium or their alloys, by means of an electrochemical and plasmachemical reaction, which is determined by a pulse voltage, with:

voltage peaks of 250 V to 750 V
pulse times of 20 μs to 2 ms
pulse frequencies of 35 Hz to 300 Hz
pulse currents of 10 A to 120 A
electrolyte temperatures of 318 K to 360 K and
average current densities of 0.1 A $cm^{-2}$ to 1 A $cm^{-2}$.

It has been found that voltages which are associated with the arc-discharge region in the current-voltage characteristic of the electrolyte-metal pairing, and which usually cause destruction of the coating, do yield an all-round homogeneous coating in connection with pulse operation up to 300 Hz.

It has appeared that pulse operation, especially with a spike pulse character, greatly minimizes the partial anode region, and the energy fed into the substrate is localized so that the individual discharge focal spots overlap strongly and lead to a uniform coating thickness with only slight roughness. Furthermore, a pulse operation according to the invention also makes it possible to form colored coatings of high quality and color depth even in electrolytes with a high concentration (up to 20%) of transition metal ions.

It has also been found that, when the electrolytes with their coloring additives have a temperature of 318 K to 360 K, the coloration of the coating is enhanced and that average current densities of 0.1 A to 1.0 A $cm^{-2}$ especially lead to matte surfaces. Another surprising effect has also appeared. For example in an electrolyte containing cobalt ions, with pulse-voltage operation, it is not the familiar black-grey deposits of cobalt-oxide compounds that appear on the aluminum metal surface but rather a visually and mechanically high-grade coating of matte-blue, cobalt-aluminum spinel.

In this fashion, copper ions in the electrolyte with the same concentrations of 1% to 20% create light yellow to ocher coatings, manganese ions create pink to umber coatings, chromium ions create green to black coatings, iron ions create light grey to deep black coatings, and molybdenum ions create light grey to dark grey coatings.

The coatings created according to the inventive process have an average surface roughness of 4 μm to 20 μm and consist of two different coating regions. The coating region which is adjacent to the metal surface is transparent or white and has a thickness of 0.1 μm to 1.5 μm. The cover coating region which adjoins this transparent or white coating region is white, black, colored, matte, and opaque, and has a thickness of 3 μm to 25 μm. With a coating thickness of 30 μm, which is the maximum that is achievable according to the invention, transition zone appears between the transparent or white coating region and the cover coating region.

The transparent or white coating region contains no color-producing transition metal ions and acts as an adhesive agent to the cover coating region.

The lattice parameter deviations of the metal with respect to the transparent coating region are small because of the field crystallization effect, so that no mechanical strains occur at the boundary surfaces between the metal and metal oxide of the transparent or white coating regions. Furthermore, the transparent or white coating region and the cover coating region consist of the same basic metal oxide. Thus, despite the lattice expansion of the oxides in the cover coating region, also caused by the built-in transition metal ions, a high bonding stability is guaranteed between the two oxide layers. The coloration in the cover coating region is caused by the inclusion of transition metal ions. These inorganic coloring substances are not subject to the risk of bleaching. Non-fading spinels or mixed oxides result. By a multiple anodic treatment in various electrolytes, in accord with the invention, several cover coating regions of different colors can be formed, thus forming homogeneous and/or heterogeneous color distributions. The matte appearance of these decorative coatings is characterized by their very low sheen. Sheen measurements according to RICHTER yielded sheen figures from 0.5 to 1.5, independent of the reflection angle. This implies a completely matte surface. Various concentrations of transition metal ions in the cover coating region, whose mass fraction varies up to 20%, yielded color shadings associated with a homogeneous or marbled or speckled or mottled or mosaic-like appearance. The metal surfaces can be equipped in whole or in part with the anodic oxide coating. Many design variants result from combining surface regions with variously colored and transparent and/or interference-colored and/or other conventional anodic coatings.

Jewelry articles which are treated by the inventive process are distinguished by good body tolerance because the chemically indifferent oxide coatings prevent direct contact between the metal and the skin.

DETAILED DESCRIPTION OF THE PREFERRED EMBODIMENTS

The invention is further described in detail by the following examples.

EXAMPLE 1

Cufflinks of titanium are connected as the anode in an electrolyte containing 0.1 mol/l $Na_2B_4O_7$ and 0.5 mol/l $KH_2PO_4$. At a voltage of 60 V, the cufflinks receive an intensely red, characteristic oxide coating. The cufflinks are half covered with a protective device, and are anodically oxidized in an aqueous electrolyte with the composition: 0.5 mol/l NaF, 0.3 mol/l $NaH_2PO_4$, 0.1 mol/l $Na_2B_4O_7$, and 0.5 mol/l $K_4[Fe(CN)_6]$, at a pH value of 8, with a pulse current density of 0.1 A/cm$^2$, and for a time of 60 seconds. The result is a combination of a deep red, interference-colored, characteristic coating and a deep-black, matte, oxide-ceramic coating.

EXAMPLE 2

A simulation of antique cameo (portrait) consisting of an aluminum alloy was anodically oxidized in an aqueous electrolyte with a concentration of 0.5 mol/l NaF, 0.5 mol/l $NaH_2PO_4$, and 0.1 mol/l $Na_2B_4O_7$, with a pulse current density of 0.2 A/cm$^2$, and a pulse voltage of 110 V. A white, matte, porcelain-like coating with an ivory look appears on the jewelry object. Its surface roughness is 7.6 μm, and the average coating thickness is 10.1 μm. The portrait is reproduced true to form.

EXAMPLE 3

An aluminum brooch with 12 cm$^2$ of surface and the initials C.D. is connected as anode in an aqueous electrolyte at 338 K, which contains 2% NaF, 7% $NaH_2PO_4$, 4% $Na_2B_4O_7$, 0.5% $NH_4F$, and 1% ammoniacal $Co(OH)_2$. It is coated using a pulse voltage with 500 V voltage peaks, a pulse time of 1 ms, and a pulse frequency of 100 Hz. The maximum pulse current was measured at 50 A. The result is a matte blue, non-shiny surface of high decorative value. The initials are reproduced true to form, with a deviation of only 8 μm after the coating.

EXAMPLE 4

The front panel of an electronic amplifier with 400 cm$^2$ of surface, consisting of aluminum [Al 99.5], is treated anodically with a pulse voltage in an aqueous electrolyte, which contains 4% NaF, 6% $Na_2CO_3$, and 4% $Na_2B_4O_7$. The pulse voltage peaks were 410 V, the pulse times were 0.5 ms, the pulse current was 35 A, and the pulse frequency was 100 Hz. After 10 minutes of treatment time, the front panel is homogeneously coated on all sides with a white, matte, porcelain-like, decorative coating 9 μm thick.

EXAMPLE 5

A picture frame with an engraved pattern and with 840 cm$^2$ of surface, has its rear side masked, while its front side is coated decoratively in an electrolyte containing 2% $KMnO_4$, 6% NaF, 7% $NaH_2PO_4$, 3% $NH_4F$, and 4% $Na_2B_4O_7$. The pulse voltage peaks are 550 V, the pulse current peaks are 58 A, the pulse times are 1.2 ms, and the pulse frequency is 100 Hz. The resulting light-to-pink-brown coating is 7 μm thick. The coating has no sheen, has a ceramic-like appearance, and has a special decorative effect. The engraved pattern is reproduced true to form with a uniform change of only 12 μm after the coating. The average roughness is 8 μm.

What we claim is:

1. A method for preparing a decorative coating for a metal substrate in an aqueous electrolyte comprising subjecting a barrier-layer forming metal substrate selected from aluminum, titanium, tantalum, zirconium, niobium, and an alloy thereof to an electrochemical and plasma-chemical reaction which is determined by the pulse voltage, and which has the following characteristics:

voltage peaks of 250 V to 750 V,
a voltage time of 20 μs to 2 ms,
a pulse frequency of 35 Hz to 300 Hz,
a pulse current of 10 A to 120 A,
an electrolyte temperature of 318 K to 360 K and
an average current density of 0.1 A cm$^{-2}$ to 1 A cm$^{-2}$,
whereby a matte, true to form, decorative white coating with a homogeneous thickness of 3 μm to 30 μm is formed.

2. The process according to claim 1 in which the aqueous electrolyte contains a transition metal ion in a concentration of 1% to 20% and in which a colored or black matte coating is created.

3. The process according to claim 1 in which variously colored coatings having homogeneous and heterogeneous color distributions are created by multiple electromechanical and plasma-chemical reactions using a different electrolyte for each reaction.

4. The process according to claim 1 in which the metal substrate is useful as jewelry.

5. The process according to claim 1 in which the metal substrate contains engraving.

6. The process according to claim 1 in which the substrate is an object with a large surface area.

7. A metal substrate having a decorative coating prepared by the method of claim 1.

8. A metal substrate useful as jewelry having a decorative coating prepared by the method of claim 1.

9. An engraved object having a decorative coating prepared by the method of claim 1.

* * * * *